US009834410B2

(12) United States Patent
Zerelles et al.

(10) Patent No.: US 9,834,410 B2
(45) Date of Patent: Dec. 5, 2017

(54) ELEVATOR INSTALLATION

(71) Applicant: ThyssenKrupp Elevator AG, Essen (DE)

(72) Inventors: Holger Zerelles, Leinfelden-Echterdingen (DE); Bernd Altenburger, Neuhausen (DE); Ronald Dietze, Leinfelden-Echterdingen (DE); Juri Schäfer, Stuttgart (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 0 days.

(21) Appl. No.: 15/025,614

(22) PCT Filed: Sep. 29, 2014

(86) PCT No.: PCT/EP2014/002638
§ 371 (c)(1),
(2) Date: Mar. 29, 2016

(87) PCT Pub. No.: WO2015/043759
PCT Pub. Date: Apr. 2, 2015

(65) Prior Publication Data

US 2016/0297645 A1 Oct. 13, 2016

(30) Foreign Application Priority Data

Sep. 30, 2013 (DE) ..... 10 2013 110 792

(51) Int. Cl.
*B66B 9/00* (2006.01)
*B66B 7/06* (2006.01)
*B66B 5/02* (2006.01)

(52) U.S. Cl.
CPC ..... *B66B 9/00* (2013.01); *B66B 7/06* (2013.01); *B66B 2009/006* (2013.01)

(58) Field of Classification Search
CPC ..... B66B 2009/006; B66B 11/0095; B66B 5/0018; B66B 5/0031; B66B 3/0023; B66B 1/40
See application file for complete search history.

(56) References Cited

U.S. PATENT DOCUMENTS 4,079,816 A * 3/1978 Ohta ..... B66B 7/06 174/42
5,103,937 A * 4/1992 Robertson ..... B66B 7/06 174/42

(Continued)

FOREIGN PATENT DOCUMENTS

CN 101563285 A 10/2009
JP 110 36038 A 2/1998

(Continued)

OTHER PUBLICATIONS

German language International Search Report for International patent application No. PCT/EP2014/002638; dated Dec. 19, 2014.

(Continued)

*Primary Examiner* — William A Rivera
*Assistant Examiner* — Stefan Kruer
(74) *Attorney, Agent, or Firm* — thyssenkrupp North America, Inc.

(57) ABSTRACT

An elevator installation includes a shaft in which a first elevator car and a second elevator car arranged below the first elevator car are movable upward and downward in the vertical direction separately from each other. Each elevator car is coupled to a counterweight via a rope or belt arrangement. At least one rope or belt arrangement has two rope or belt sections via which one of the elevator cars is coupled to a counterweight and which extend laterally along the other elevator car. In order to avoid impairment of an elevator car by rope or belt oscillations, the elevator car has at least one limiting member which is held in a predetermined position (Continued)

in the shaft and is assigned to a rope or belt section and has at least one limiting element which is movable between a limiting position and a release position depending on the position of the elevator car which is coupled to the counterweight via the associated rope or belt section. In the limiting position, the limiting element can be positioned on that side of the rope or belt section which faces the elevator car, and, in the release position, the limiting element releases said side.

20 Claims, 3 Drawing Sheets

(56) References Cited

U.S. PATENT DOCUMENTS 5,947,232 A * 9/1999 Traktovenko ..... B66B 7/06 187/411
7,793,763 B2 * 9/2010 Zhu ..... B66B 7/06 187/251
9,359,172 B2 * 6/2016 Mangini ..... B66B 7/06
2010/0065381 A1 * 3/2010 Roberts ..... B66B 7/06 187/401

FOREIGN PATENT DOCUMENTS

WO 2004/048243 A1 6/2004
WO 2008/079145 A1 7/2008
WO 2009080538 A 7/2009

OTHER PUBLICATIONS

English translation of International Search Report for International patent application No. PCT/EP2014/002638, dated Dec. 19, 2014.
German language Written Opinion of the International Search Authority for International patent application No. PCT/EP2014/002638; dated Dec. 19, 2014.
English translation of abstract for JP H10 36038 A.
English abstract of CN 101563285A.

* cited by examiner

ELEVATOR INSTALLATION

CROSS REFERENCE TO RELATED APPLICATIONS

This application is a U.S. National Stage Entry of International Patent Application Serial Number PCT/EP2014/002638, filed Sep. 29, 2014, which claims priority to German patent application no. 102013110792.3, filed Sep. 30, 2013.

FIELD

The present disclosure relates to an elevator installation.

BACKGROUND

In order to convey a multiplicity of individuals within a short time by means of an elevator installation, it is known from international laid-open application WO 2004/048243 A1 to arrange at least two elevator cars one above another in a shaft and to move same upward and downward vertically separately from each other. Each elevator car is assigned a driving device with a drive pulley, with the aid of which the elevator car can be driven. The two elevator cars can be moved upward and downward along a common track in the shaft.

The two elevator cars are each connected to a counterweight via a rope or belt arrangement. At least one rope or belt arrangement here has two rope or belt sections via which one of the two elevator cars is coupled to the counterweight thereof and which run along at least one side of the other elevator car. For example, provision may be made for the second elevator car, which is arranged below the first elevator car, to be suspended on two supporting rope or supporting belt sections via which the second elevator car is coupled to the second counterweight and which extend upward vertically from the second elevator car and each run along a side of the first elevator car, and therefore the first elevator car is positioned between the two supporting rope or supporting belt sections of the second elevator car.

Elevator installations with two elevator cars which are arranged one above another in a shaft and are movable separately from each other are used in particular in the case of very high buildings. In these cases, the rope or belt arrangements have very great lengths. In this connection, the rope or belt arrangements may be induced into oscillations which are caused, for example, by a movement of the building in which the elevator installation is installed. Building movements of this type can occur because of wind loads or, for example, also in the event of an earthquake. The oscillations lead to deflections of the rope or belt arrangements in the horizontal direction. There is the risk in this case of rope or belt sections which run laterally along an elevator car coming into contact with the elevator car. This may lead to damage to the elevator car or else of the rope or belt sections. Furthermore, the contact with the elevator car causes the production of noises which may unsettle the passengers in the elevator car.

Accordingly, there is a need for an elevator installation of the type discussed above which prevents or minimizes the occurrence of oscillations in the rope or belt section, which may otherwise impair the elevator car.

BRIEF DESCRIPTION OF THE DRAWINGS

The present disclosure is described in detail below with reference to the attached drawing figures, wherein.

DETAILED DESCRIPTION

Figure 1:
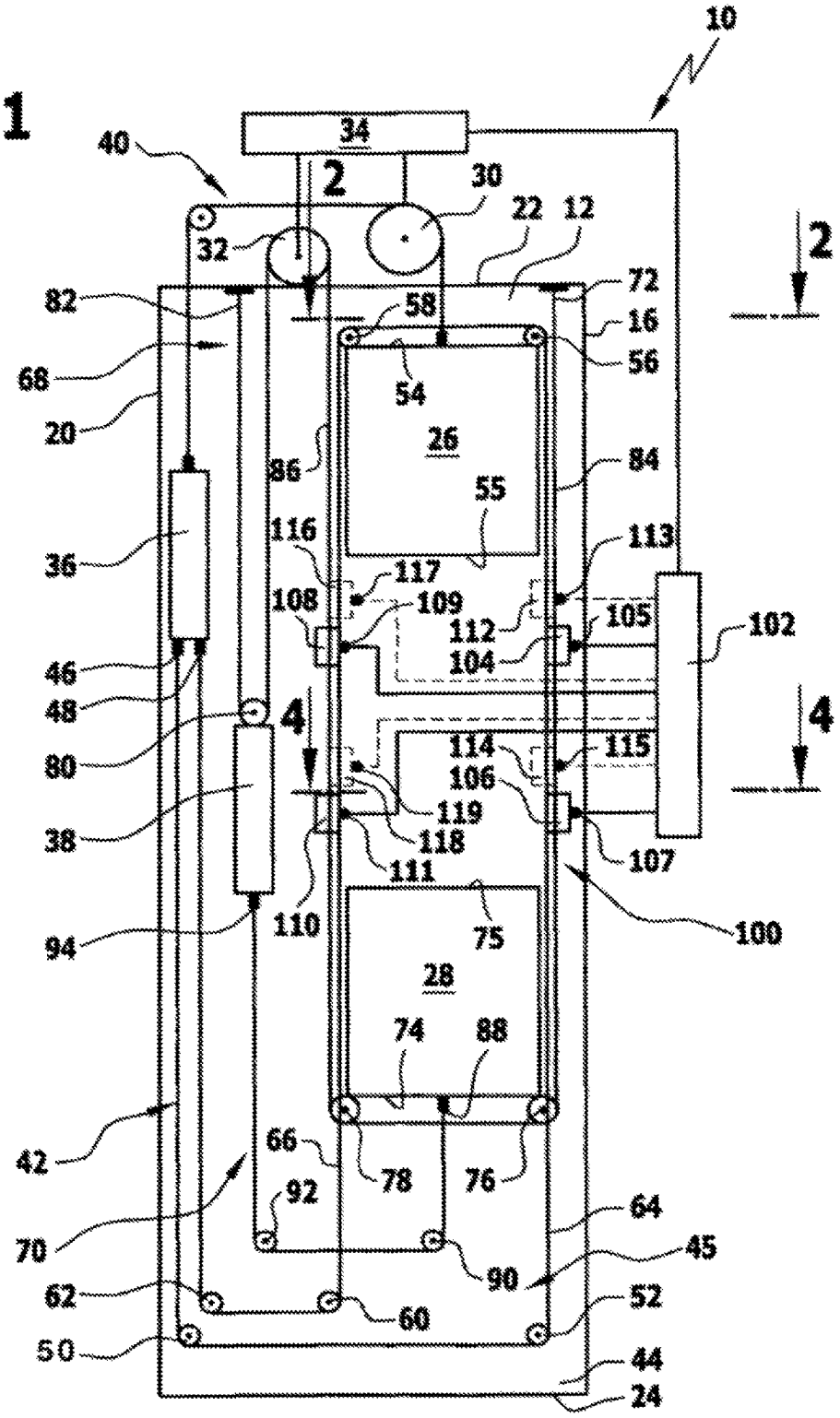
FIG. 1 is a schematic side view of an embodiment of an elevator installation of the present disclosure.

The invention relates to an elevator installation with a shaft in which a first elevator car and a second elevator car arranged below the first elevator car are movable upward and downward in the vertical direction separately from each other, wherein the first elevator car is coupled to a first counterweight via a first rope or belt arrangement and the second elevator car is coupled to a second counterweight via a second rope or belt arrangement, and wherein at least one rope or belt arrangement has two rope or belt sections via which one of the two elevator cars is coupled to the counterweight and which run along at least one side of the other elevator car. For simplicity, it should be understood that any reference herein or in the claims to a "rope" should be understood to include both ropes and belts, as well as any other similar or known elevator suspension or hoisting member or structure, and should not otherwise be read to limit the scope of the present disclosure.

An elevator installation of the present disclosure limits rope or belt oscillations by the having at least one limiting member held in a predetermined position in the shaft. The at least one limiting member is assigned to a rope or belt section and has at least one limiting element, wherein the at least one limiting element is movable between a limiting position and a release position, depending on the position of the elevator car which is coupled to the counterweight via the associated rope or belt section. In the limiting position, the at least one limiting element can be positioned on that side of the associated rope or belt section which faces the elevator car that is coupled to a counterweight via the rope or belt section. In the release position, the at least one limiting element releases said side.

The elevator installation according to the invention has at least one limiting member, with the aid of which any oscillations of a rope or belt section assigned to the limiting member can be limited. The limiting member has at least one limiting element which is movable to and fro between a limiting position and a release position. Provision may be made for use to be made of a plurality of limiting members, wherein each rope or belt section which runs along a side of an elevator car is assigned at least one limiting member. In the limiting position, the limiting element can be positioned on that side of the associated rope or belt section which faces the elevator car coupled to a counterweight via the rope or belt section. In the release position, the at least one limiting element releases said side of the rope or belt section.

By positioning the at least one limiting element on that side of the rope or belt section which faces the elevator car coupled to a counterweight via the rope or belt section, a deflection of the rope or belt section in the direction of the elevator can be obstructed. In the limiting position, the at least one limiting element therefore counteracts an oscillation of the rope or belt section in the direction of the elevator car.

However, the elevator cars should not be impaired by the at least one limiting member as they travel past the latter. This does not constitute any problem for the elevator car which does not undergo any coupling with the counterweight thereof via the rope or belt section assigned to the limiting member, since the elevator car together with all of the components thereof can take up a sufficiently large distance from the limiting member in the horizontal direction such that a collision can be avoided even if said elevator car takes up a position at the same height as the limiting member. However, for the elevator car which is coupled to the counterweight thereof via the rope or belt section assigned to the limiting member, the problem arises that, for the securing or deflection of the rope or belt section, the elevator car may have one or more laterally protruding fastening or deflecting members which may collide with a limiting element if the elevator car is positioned at the same height as the limiting member. In order to avoid this, the at least one limiting element can take up a release position in which said limiting element releases that side of the associated rope or belt section which faces the elevator car. A collision with components of the elevator car which is coupled to the counterweight thereof via the rope or belt section assigned to the limiting member is therefore also prevented in the release position.

The positioning of the at least one limiting element in the limiting position and the release position takes place depending on the position of the elevator car which is coupled to the counterweight thereof via the rope or belt section assigned to the limiting member. In the release position, the at least one limiting element also takes up a distance from the elevator car which is coupled to the counterweight thereof via the rope or belt section assigned to the limiting member. A collision with said elevator car is therefore reliably avoided. So that the at least one limiting element takes up the release position thereof promptly, the movement of the limiting element takes place depending on the position of the elevator car which is coupled to the counterweight thereof via the rope or belt section assigned to the limiting member. The optional positioning of the at least one limiting element in a limiting position and a release position firstly therefore permits a limitation of deflections of a rope or belt section and, secondly, it is ensured that the at least one limiting element cannot collide with an elevator car.

For example, it can be provided that the second rope or belt arrangement has a supporting rope or supporting belt arrangement on which the second elevator car is suspended and which is guided around a second drive pulley arranged above the two elevator cars and couples the second elevator car to the counterweight and which has two supporting rope or supporting belt sections which extend laterally along the first elevator car, wherein each of the supporting rope or supporting belt sections is assigned at least one limiting member. In the case of such a configuration, lateral deflections of the supporting rope or supporting belt sections, in particular in the direction of the first elevator car, along which they are guided laterally, can be limited by at least one limiting element taking up the limiting position thereof.

In particular, it can be provided that each supporting rope or supporting belt section is assigned at least two limiting members, with the aid of which deflections of the supporting rope or supporting belt sections in the direction of the first elevator car can be limited.

The at least two limiting members which are assigned to a supporting rope or supporting belt section are preferably arranged distributed uniformly in the vertical direction in a shaft region which extends between the uppermost stop of the first elevator car and the lowermost stop of the second elevator car.

It is of advantage if each supporting rope or supporting belt section running laterally past the first elevator car is assigned at least one limiting member, wherein the at least one limiting element of the limiting member automatically takes up the limiting position thereof if the second elevator car, in a position below the limiting member, exceeds a predetermined minimum distance from said limiting member, and wherein the at least one limiting element of the limiting member automatically takes up the release position thereof if the second elevator car falls short of the predetermined minimum distance from said limiting member. In particular, it can be provided that the at least one limiting element is automatically movable into the limiting position thereof as soon as the second elevator car exceeds the predetermined minimum distance. This ensures that the limiting element limits deflections of the associated supporting rope or supporting belt section as soon as the second elevator car exceeds the predetermined minimum distance after said elevator car has moved past the limiting member during a trip downward.

If the second elevator car is located at a distance which is greater than the minimum distance above the at least one limiting member, which is assigned to the supporting rope or supporting belt section via which the second elevator car is coupled to the counterweight thereof, said supporting rope or supporting belt section is also located above the limiting member. In this case, it is insignificant whether the limiting element of the limiting member takes up the limiting position or release position thereof since the supporting rope or supporting belt section is not located in the engagement region of the limiting element.

In particular in the case of very high buildings and accordingly very long supporting rope or supporting belt arrangements, it is favorable if the weight of each supporting rope or supporting belt arrangement is compensated for by a compensating rope or compensating belt arrangement. In the case of such a configuration, each elevator car is coupled to the counterweight thereof not only via a supporting rope or supporting belt arrangement, but also via a compensating rope or compensating belt arrangement. The supporting rope or supporting belt arrangement is guided via a drive pulley which is positioned above the two elevator cars, and the compensating rope or compensating belt arrangement is guided via a rope deflection device which is positioned below the two elevator cars. The weight of the compensating rope or compensating belt arrangement compensates for the weight of the supporting rope or supporting belt arrangement.

In an advantageous configuration of the invention, the first rope or belt arrangement has a compensating rope or compensating belt arrangement which is guided around a rope deflecting device arranged below the two elevator cars and couples the first elevator car to the first counterweight and which has two compensating rope or compensating belt sections which extend laterally along the second elevator car, wherein each compensating rope or compensating belt section is assigned at least one limiting member. In the case of such a configuration, lateral deflections of the compensating rope or compensating belt sections can be limited, in particular in the direction of the second elevator car along which they are guided laterally, by the associated limiting elements taking up the limiting position thereof.

It can be provided that each compensating rope or compensating belt section is assigned at least two limiting members. The at least two limiting members are advantageously arranged distributed uniformly in a shaft region which extends between the uppermost stop of the first elevator car and the lowermost stop of the second elevator car.

It is of advantage if each compensating rope or compensating belt section running laterally past the second elevator car is assigned at least one limiting member, wherein the at least one limiting element of the limiting member automatically takes up the limiting position thereof if the first elevator car, in a position above the limiting member, exceeds a predetermined minimum distance from said limiting member, and wherein the at least one limiting element of the limiting member automatically takes up the release position thereof if the first elevator car falls short of the predetermined minimum distance. In particular, it can be provided that the at least one limiting element is automatically movable into the limiting position thereof as soon as the first elevator car exceeds the predetermined minimum distance. This ensures that the limiting element limits deflections of the associated compensating rope or compensating belt section as soon as the first elevator car exceeds the minimum distance after said elevator car has traveled past the limiting element during a trip upward.

If the first elevator car is located at a distance which is greater than the minimum distance below the at least one limiting member, which is assigned to the compensating rope or compensating belt section via which the first elevator car is coupled to the counterweight thereof, said compensating rope or compensating belt section is also located below the limiting member. In this case, it is insignificant whether the limiting element takes up the limiting position or release position thereof since the compensating rope or compensating belt section is not located in the engagement region of the limiting element.

In an advantageous configuration of the invention, at least one elevator car has two fastening or deflecting members which each protrude laterally over a side wall of the elevator car and to or at which a respective rope or belt section is secured or deflected, and the limiting elements of the limiting members assigned to said rope or belt sections, in the limiting position thereof, enter the region of the vertical projection of a fastening or deflecting member and, in the release position thereof, are arranged outside the vertical projection of the fastening or deflecting members. The fastening or deflecting members arranged on at least one elevator car protrude laterally outward in order to fasten a rope or belt section to said elevator car or to deflect same at said elevator car. The limiting elements of the fastening members assigned to said rope or belt sections project, in the limiting position thereof, into the region of a vertical projection of the fastening or limiting members. In order, however, to avoid damage to the fastening or deflecting members, the limiting elements only take up the limiting position if the elevator car exceeds a predetermined minimum distance from the respective limiting member. If the elevator car falls short of the minimum distance, the limiting elements take up the release position thereof in which they are arranged outside the vertical projection of the fastening or deflecting members and therefore cannot impair the fastening or deflecting members when the elevator car travels past the latter.

As already explained, horizontal deflections of a rope or belt section can be limited in the direction of an elevator car with the aid of the at least one limiting element. It is of particular advantage if oscillations of the rope or belt section can also be limited in other directions by means of the limiting element. In an advantageous embodiment of the elevator installation according to the invention, the at least one limiting element, in the limiting position thereof, engages behind a rope or belt section for this purpose. As a result, it can be ensured in a structurally simple manner that oscillations of the rope or belt section in the direction of an elevator car are obstructed just as oscillations are in another direction, in particular in a direction perpendicular thereto.

The at least one limiting member preferably has two limiting elements which, in the limiting position thereof, engage around a rope or belt section in the manner of clamps.

For example, it can be provided that the two limiting elements form two clamping jaws which are mounted so as to be pivotable to and fro between the release position and the limiting position. The clamping jaws can be, for example, of C- or L-shaped configuration.

The two clamping jaws are advantageously mounted pivotably on a bearing element which can be secured to a shaft wall.

The bearing element is advantageously of plate-like design.

The at least one limiting member preferably has a controllable motorized driving element which is coupled to a control device. The driving element can be configured, for example, as a hydraulic or pneumatic piston-cylinder unit or, for example, also as an electric motor. The at least one limiting element of the limiting member can be moved by the driving element.

The controllable driving element is coupled to a control device. An elevator control apparatus which controls the operation of the entire elevator installation can be used as the control device.

It can be provided that the elevator installation has an oscillation-limiting controller which is connected to the controllable driving element of the at least one limiting member. The oscillation-limiting controller can additionally be connected to an elevator control apparatus of the elevator installation, wherein the elevator control apparatus supplies position data of the two elevator cars to the oscillation-limiting controller. On the basis of the position data, the oscillation-limiting controller can determine the distance of the elevator cars from the at least one limiting member. If a predetermined minimum distance is fallen short of, the oscillation-limiting controller can supply a control signal to a driving element, under the action of which control signal the at least one limiting element of the limiting member is moved by the driving element into the release position thereof. If the minimum distance is exceeded, the oscillation-limiting controller can supply a control signal to the driving element, under the action of which control signal the limiting element is moved by the driving element into the limiting position thereof.

The drawing is a schematic illustration of an advantageous embodiment of an elevator installation according to the invention which is covered as a whole by the reference sign 10. The elevator installation 10 comprises a shaft 12 which, in the exemplary embodiment illustrated, has a rectangular cross section with a first shaft wall 14, a second shaft wall 16, a third shaft wall 18 and a fourth shaft wall 20. In addition, the shaft 12 has a shaft ceiling 22 and a shaft floor 24.

In the shaft 12, a first elevator car 26 and a second elevator car 28 are movable upward and downward in the vertical direction separately from each other along common guide rails, which are not illustrated in order to obtain better clarity in the drawing. The first elevator car 26 is arranged above the second elevator car 28. The first elevator car 26 is assigned a first driving device with a first drive pulley 30, and the second elevator car 28 is assigned a second driving device with a second drive pulley 32. The two drive pulleys 30, 32 can each be set into rotation by a driving motor. The driving motors of the drive pulleys 30, 32 are connected to an elevator control apparatus 34 which controls the driving motors.

The first elevator car 26 is coupled to a first counterweight 36 via a first rope arrangement, and the second elevator car 28 is coupled to a second counterweight 38 via a second rope arrangement. In FIGS. 2 to 5, the counterweights 36 and 38 are not illustrated in order to achieve better clarity. The rope arrangements have a multiplicity of ropes. Alternatively, use could also be made of belt arrangements in which the elevator cars 26 and 28 are coupled to the counterweights 36 and 38 via a multiplicity of belts. As is explained in detail below, the rope arrangements have a plurality of rope sections which run laterally along the elevator cars 26, 28. In a corresponding manner, the elevator installation 10 can also have belt arrangements with a plurality of belt sections which, in a manner corresponding to the rope sections, run along the elevator cars 26, 28. For the sake of simplicity, the elevator installation 10 is explained in more detail below only with reference to the rope arrangements. However, the invention also relates in the same manner to elevator installations with belt arrangements.

The coupling of the first elevator car 26 to the first counterweight 36 takes place firstly via a first supporting rope arrangement 40 which is guided via the first drive pulley 30 and, secondly, via a first compensating rope arrangement 42 which runs from the first elevator car 26 in the vertical direction into the region of a shaft pit 44 and is deflected there and subsequently extends upward in the vertical direction as far as the first counterweight 36. The first compensating rope arrangement 42 has a first rope end 46 and a second rope end 48. The two rope ends 46, 48 are secured on the first counterweight 36. The first compensating rope arrangement 42 extends from the first rope end 46 vertically downward to a first deflecting roller 50 of a rope deflecting device 45. The first compensating rope arrangement 42 runs from the first deflecting roller 50 in the horizontal direction to a second deflecting roller 52 of the rope deflecting device 45. The first compensating rope arrangement 42 runs from the second deflecting roller 52 upward in the vertical direction as far as a first elevator car roller 56 which is arranged on an elevator car ceiling 54 of the first elevator car 26 and from which the first compensating rope arrangement 42 is guided in the horizontal direction to a second elevator car roller 58 likewise arranged on the elevator car ceiling 54. The first elevator car roller 56 and the second elevator car roller 58 form deflecting members and are advantageously mounted rotatably. The first compensating rope arrangement 42 extends from the second elevator car roller 58 vertically downward again into the shaft pit to a third deflecting roller 60 at which the compensating rope arrangement 42 is deflected in the horizontal direction. The third deflecting roller 60 is adjoined by a fourth deflecting roller 62 of the rope deflecting device, and the first compensating rope arrangement extends from the fourth deflecting roller 42 upward in the vertical direction as far as the second rope end 48. Instead of on the elevator car ceiling 54, the elevator car rollers 56, 58 could also be held on the elevator car floor 55 of the first elevator car.

In the region between the second deflecting roller 52 and the first elevator car roller 56, the first compensating rope arrangement 42 forms a first compensating rope section 64, and, in the region between the second elevator car roller 58 and the third deflecting roller 60 of the rope deflecting device, the first compensating rope arrangement 42 forms a second compensating rope section 66. The second elevator car 28 is arranged between the first compensating rope section 64 and the second compensating rope section 66, and therefore the first compensating rope section 64 and the second compensating rope section 66 extend on mutually opposite sides of the first elevator car and of the second elevator car 28. Instead of the elevator car rollers 56, 58, use could also be made of fastening members which are configured as rope suspension means and on which the compensating rope sections 64 and 66 are fixed on the upper side or lower side of the first elevator car. In the case of such a configuration, the horizontal section of the compensating rope arrangement 42 between the rope suspension means could be omitted.

The second elevator car 28 is coupled to the second counterweight 38 via a second supporting rope arrangement 68 and a second compensating rope arrangement 70. The second supporting rope arrangement 68 is secured at a first rope end 72 on the shaft ceiling 22. The second supporting rope arrangement 68 extends from the first rope end 72 vertically downward as far as a third elevator car roller 76 which is mounted rotatably on an elevator car floor 74 of the second elevator car 28 and is assigned to the third shaft wall 18. The second supporting rope arrangement 68 extends from the third elevator car roller 76 in the horizontal direction to a fourth elevator car roller 78 which is likewise mounted rotatably on the elevator car floor 74 and is assigned to the first shaft wall 14. The second supporting rope arrangement 68 extends from the fourth elevator car roller 78 upward in the vertical direction as far as the second drive pulley 32, from which the second supporting rope arrangement 68, in the exemplary embodiment illustrated, extends downward in the vertical direction as far as a counterweight roller 80 which is mounted rotatably on the second counterweight 38. The second supporting rope arrangement 68 extends from the counterweight roller 80 upward in the vertical direction as far as a second rope end 82 of the second supporting rope arrangement 68, which rope end is fixed on the shaft ceiling 22. Instead of on the elevator car floor 74, the elevator car rollers 76, 78 could also be held on the elevator car ceiling 75 of the second elevator car 28.

In the region between the first rope end 72 and the third elevator car roller 76, the second supporting rope arrangement 68 forms a first supporting rope section 84, and, in the region between the fourth elevator car roller 78 and the second drive pulley 32, the second supporting rope arrangement 68 forms a second supporting rope section 86. The first elevator car 26, which is arranged above the second elevator car 28, is positioned between the first supporting rope section 84 and the second supporting rope section 86, and therefore the two supporting rope sections 84, 86 extend along mutually opposite sides of the first elevator car 26 and of the second elevator car 28.

The second compensating rope arrangement 70 is secured at a first rope end 88 on the elevator car floor 74 and extends downward in the vertical direction from the first rope end 88 to a fifth deflecting roller 90 of the rope deflecting device 45. The second compensating rope arrangement 70 extends from the fifth deflecting roller 90 in the horizontal direction to a sixth deflecting roller 92 of the rope deflecting device 45, and the second compensating rope arrangement 70 extends from the sixth deflecting roller 92 as far as a second rope end 94 of the second compensating rope arrangement 70, which rope end is secured on the second counterweight 38.

The elevator installation 10 is used in particular in the case of very high buildings, and therefore the two supporting rope sections 84, 86, like the two compensating rope sections 64, 66, can have a considerable length. Oscillations of the supporting rope sections 84, 86 and the compensating rope sections 64, 66 may occur, for example, because of movements of the building in which the elevator installation 10 is installed, wherein the supporting rope sections 84, 86 and the compensating rope sections 64, 66 are deflected in the horizontal direction. In order in this case to avoid the supporting rope sections 84, 86 or else the compensating rope sections 64, 66 being able to impair the elevator cars 26, 28 during the travel thereof, the elevator installation 10 has an oscillation-limiting device 100 with a total of eight limiting members which each have two movable limiting elements and a driving element in the form of a controllable electric motor and are connected via control lines to an oscillation-limiting controller 102 which, for its part, is connected to the elevator control apparatus 34 via a connecting line.

A first limiting member 104 and a second limiting member 106, which is arranged aligned in the vertical direction and at a distance from the former, are assigned to the first supporting rope section 84 and secured on the third shaft wall 18. A third limiting member 108 and a fourth limiting member 110, which are arranged aligned with respect to each other in the vertical direction, are assigned to the second supporting rope section 86. The third limiting member 108 and the fourth limiting member 110 are secured on the first shaft wall 14.

The first compensating rope section 64 is assigned a fifth limiting member 112 and a sixth limiting member 114 which are secured aligned in the vertical direction and at a distance from each other on the third shaft wall 18, and the second compensating rope section 66 is assigned a seventh limiting member 116 and an eighth limiting member 118 which are secured aligned in the vertical direction and at a distance from each other on the first shaft wall 14. The fifth to eighth limiting members 112, 114, 116 and 118 are illustrated by dashed lines in FIG. 1 in order to achieve better clarity.

Each limiting member 104 to 118 has a controllable driving element in the form of an electric motor 105 to 119.

Figure 2:
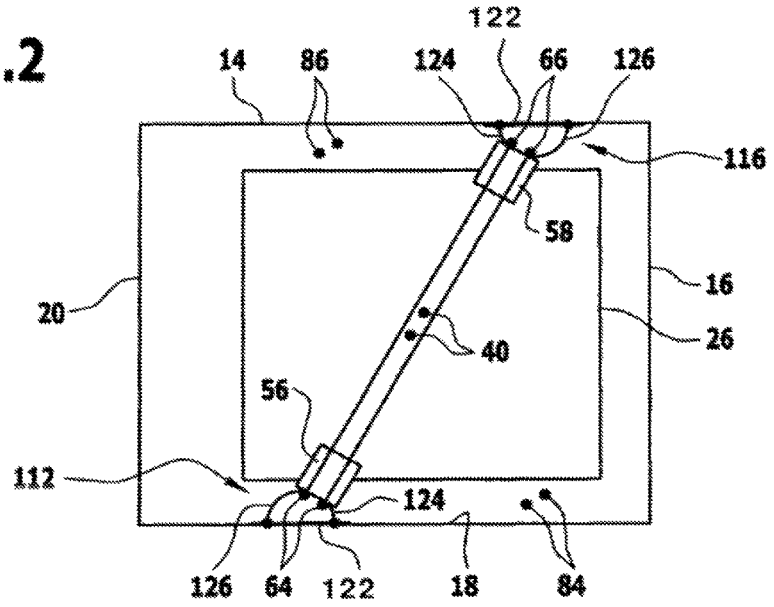
FIG. 2 is a simplified top cross-sectional view of the embodiment of FIG. 1 about section line 2-2 in FIG. 1, in which a first elevator car exceeds a predetermined minimum distance from the limiting elements of two limiting members.
Figure 3:
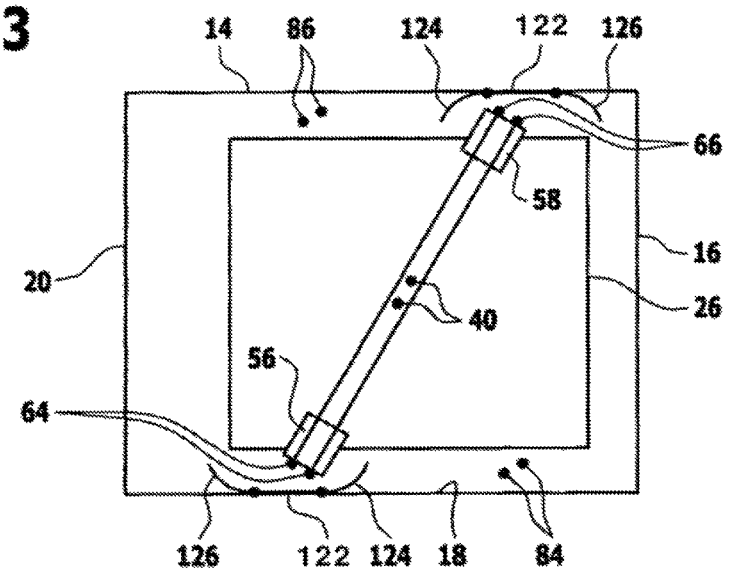
FIG. 3 is a simplified top cross-sectional view of the embodiment of FIG. 2, in which the first elevator car falls short of the minimum distance from the limiting elements of the two limiting members.
Figure 4:
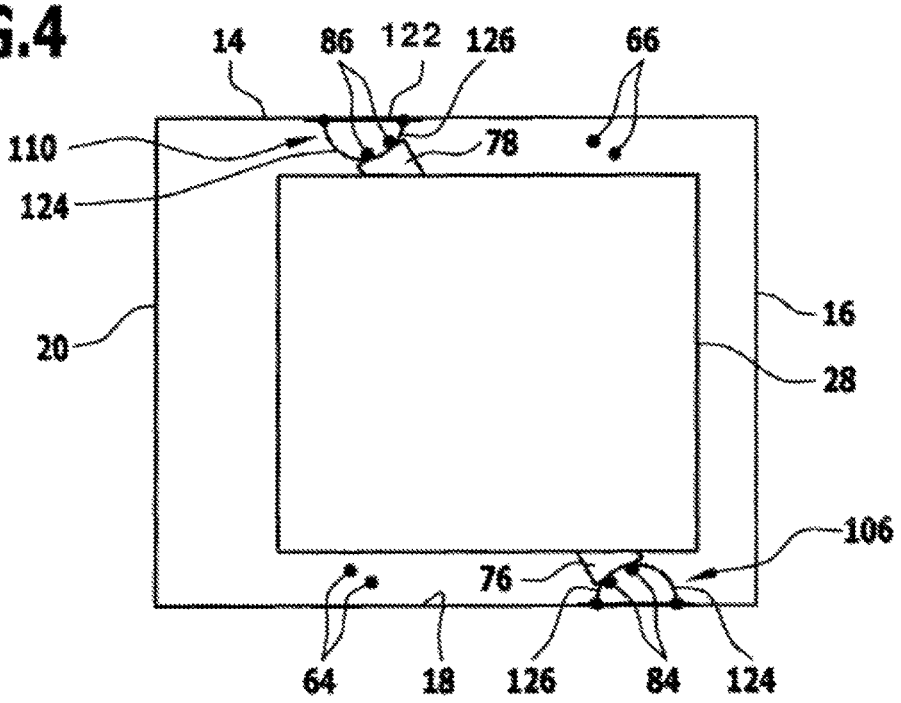
FIG. 4 is a simplified top cross-sectional view of the embodiment of FIG. 1 about section line 4-4 in FIG. 1, in which a second elevator car exceeds a predetermined minimum distance from the limiting elements of two limiting members.
Figure 5:
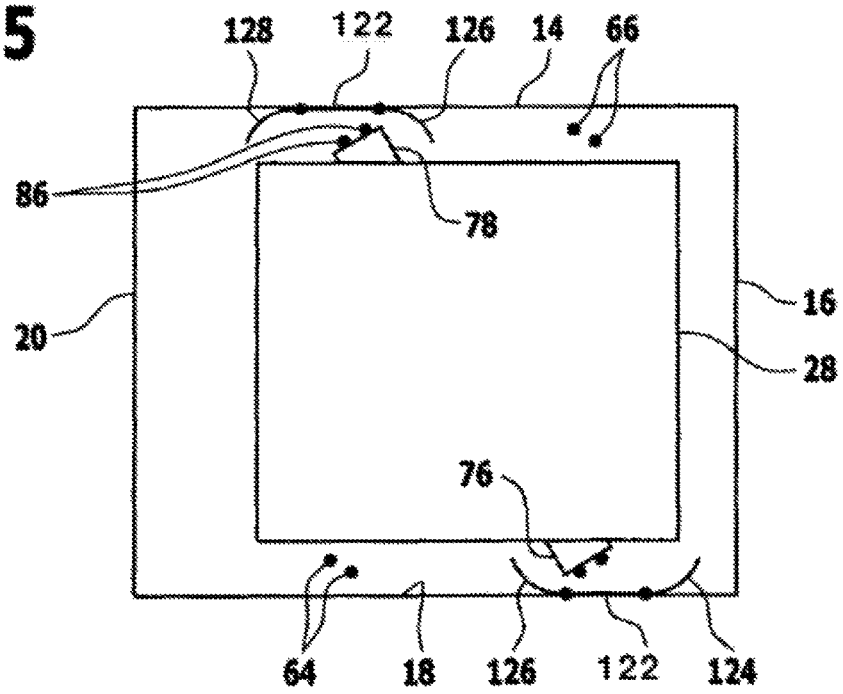
FIG. 5 is a simplified top cross-sectional view of the embodiment of FIG. 4, in which the second elevator car falls short of a predetermined minimum distance from the limiting elements of the two limiting members.

The limiting members 104 to 118 are of identical configuration. As becomes clear from FIGS. 2 to 5, the limiting members 104 to 118 each comprise a plate-like bearing element 122 which is securable on a shaft wall and on which a first limiting element 124 and a second limiting element 126 are each mounted so as to be pivotable about vertically oriented pivot axes. The two limiting elements 124, 126 are of mirror-symmetrical design with respect to each other with respect to a mirror plane oriented perpendicularly to the plate-like bearing element 122. Said limiting elements are each configured in the manner of a clamping jaw and can be pivoted horizontally to and fro between a limiting position, which is illustrated in FIGS. 2 and 4, and a release position, which is illustrated in FIGS. 3 and 5, by means of the electric motor already explained. In the limiting position, the two limiting elements 124, 126 in combination with the bearing element 122 each engage around the associated rope section. In this case, the two limiting elements 124, 126 can be positioned in the limiting position on that side of the respective rope section which faces the elevator car which is coupled to a counterweight via the rope section.

The supporting rope sections 84, 86 via which the second elevator car 28 is coupled to the second counterweight 38 therefore cannot be deflected horizontally in the direction of the first elevator car 26, along which they are guided laterally if the limiting members 104, 106, 108 and 110 take up the limiting position thereof. In a corresponding manner, the compensating rope sections 64, 66 via which the first elevator car 26 is coupled to the first counterweight 36 cannot be deflected horizontally in the direction of the second elevator car 28, along which they are guided laterally, if the limiting members 112, 114, 116 and 118 take up the limiting position thereof.

The limiting elements 124, 126, in the release position thereof, release that side of the rope or belt section which is assigned to the respective elevator car. This becomes clear from FIGS. 3 and 5. In the release position, the limiting elements 124, 126 are pivoted out in the direction of the shaft wall on which the respective limiting member is secured.

In the limiting position, the limiting elements 124, 126 of the limiting members 104, 106, 108 and 110 assigned to the supporting rope sections 84, 86 enter the region of the vertical projection of the elevator car rollers 76, 78 of the second elevator car 28, whereas said limiting elements, in the release position thereof, take up a position outside the vertical projection of the elevator car rollers 76, 78. In a corresponding manner, the limiting elements 124, 126 of the limiting members 112, 114, 116 and 118 assigned to the compensating rope sections 64, 66, in the limiting position thereof, enter the region of the vertical projection of the elevator car rollers 56, 58, whereas said limiting elements, in the release position thereof, take up a position outside the vertical projections of the elevator car rollers 56, 58.

The control of the limiting members 104 to 110 assigned to the supporting rope sections 84, 86 takes place depending on the distances which the second elevator car 28 coupled to the second counterweight 38 via the supporting rope sections 84, 86 has from the limiting members 104 to 118. In a corresponding manner, the control of the limiting members 112 to 118 assigned to the compensating rope sections 64, 66 takes place depending on the distances which the first elevator car 26 coupled to the first counterweight 36 via the compensating rope sections 64, 66 has from the limiting members 112 to 118. For this purpose, the rope oscillation-limiting controller 102 is supplied with the position data of the two elevator cars 26, 28 by the elevator control apparatus 34. On the basis of the supplied position data, the oscillation-limiting controller 102 calculates the distances which the first elevator car 26 and the second elevator car 28 have from the respective limiting members 104 to 118. If the current distance exceeds a predetermined minimum distance, the oscillation-limiting controller controls the limiting elements 124, 126 of the respective limiting member 104 to 118 in such a manner that the limiting elements 124, 126 take up the limiting position thereof in which said limiting elements engage around the respectively associated rope or belt section. Although, in this position, the limiting elements 124, 126 enter the vertical projections of the laterally outwardly protruding elevator car rollers 56, 58, 76, 78 of the respective elevator cars 26 and 28, since the elevator cars 26, 28 exceed the predetermined minimum distance there is no risk of the limiting elements 124, 126 colliding with the elevator cars 26, 28. If, however, the current distance of the elevator cars 26, 28 falls short of the predetermined minimum distance, the oscillation-limiting controller 102 controls the movement of the limiting elements 124, 126 of the respective limiting member 104 to 118 in such a manner that the limiting elements 124, 126 take up the release position thereof in which said limiting elements are arranged outside the vertical projection of the elevator car rollers 56, 58, 76, 78, and therefore the elevator cars 26, 28 can travel past the limiting members 104 to 118 without a collision.

By the use of the two elevator cars 26, 28 which can be moved upward and downward in the vertical direction separately from each other in the shaft 12, a multiplicity of individuals can be conveyed within a short time by means of the elevator installation 10. The compensating rope sections 64, 66 via which the first elevator car 26 is coupled to the first counterweight 36 are guided laterally along the second elevator car 28, and the supporting rope sections 84, 86 via which the second elevator car 28 is coupled to the second counterweight 38 are guided laterally along the first elevator car 26. In order, in the event of rope oscillations developing, to avoid the compensating rope sections 64, 66 being able to obstruct the second elevator car 28, or the supporting rope sections 84, 86 being able to obstruct the first elevator car, use is made of the oscillation-limiting device 100 which counteracts rope oscillations of this type.

The invention claimed is:

1. An elevator installation, comprising:

an elevator shaft;

a first elevator car disposed in, and moveable in an upward and downward vertical direction, within said shaft;

a second elevator car disposed in said shaft below said first elevator car, and moveable, separately from said first elevator car, in an upward and downward vertical direction within said shaft;

a first counterweight coupled to said first elevator car by a first rope arrangement connected there between;

a second counterweight coupled to said second elevator car by a second rope arrangement connected there between, at least one of said first or second rope arrangements comprising a first rope-section and a second rope-section that each extend along at least one side of said respective first or second elevator car to which said rope-sections are not coupled; and a limiting member having a first limiting element, said limiting member being fixed at a predetermined position in said shaft and assigned to said first rope-section, said limiting member being configured to limit oscillations of said first rope-section, wherein said first limiting element is configured to be selectively switched between a limiting position and a release position, based on a vertical position in said elevator shaft of said first or second elevator car that is coupled to its respective counterweight by said respective rope-section, wherein in the limiting position, at least a portion of said first limiting element is configured to be positioned on a side of said first rope-section that faces said first or second elevator car that is coupled to its respective counterweight by said first rope-section, and wherein in the release position, said first limiting element releases said first rope-section.

2. The elevator installation of claim 1, further comprising:

a drive pulley disposed above both the first and second elevator cars, wherein said second rope arrangement comprises a second supporting rope having said first and second rope-sections configured as first and second supporting rope-sections that each extend laterally along said first elevator car, said second supporting rope being guided around and supported on said drive pulley and coupling said second elevator car to said second counterweight, and wherein each of said first and second supporting rope-section is assigned a limiting member.

3. The elevator installation of claim 2, wherein said limiting element of each limiting member is configured to be actuated to its limiting position when said second elevator car exceeds a predetermined minimum distance below said limiting member, and wherein said limiting element of each limiting member is configured to be actuated to its release position when said second elevator car is less than the predetermined minimum distance below said limiting member.

4. The elevator installation of claim 1, further comprising:

a rope deflecting device disposed in said elevator shaft below both of said first and second elevator cars, wherein said first rope arrangement comprises a first compensating rope having said first and second rope-sections configured as first and second compensating rope-sections that each extend laterally along said second elevator car, said first compensating rope being guided around said rope deflecting device and coupling said first elevator car to said first counterweight, and wherein each of said first and second compensating rope-section is assigned a limiting member.

5. The elevator installation of claim 4, wherein said limiting element of each limiting member is configured to be actuated to its limiting position when said first elevator car exceeds a predetermined minimum distance above said limiting member, and wherein said limiting element of each limiting member is configured to be actuated to its release position when said first elevator car is less than the predetermined minimum distance above said limiting member.

6. The elevator installation of claim 1, wherein said limiting member has a first limiting element and a second limiting element that are configured to clamp around one of said first or second rope sections when said first and second limiting elements are in the limiting position.

7. The elevator installation of claim 6, wherein said first and second limiting elements are each pivotable between the release position and the limiting position.

8. The elevator installation of claim 7, wherein said limiting member comprises a bearing element on which said first and second limiting elements are pivotably mounted and which can be secured to a wall of said elevator shaft.

9. The elevator installation of claim 1, wherein said limiting member comprises a controllable motorized driving element configured to be coupled to and controlled by a control device.

10. The elevator installation of claim 9, further comprising:

an oscillation-limiting controller in operative communication with said controllable motorized driving element.

11. The elevator installation of claim 1, further comprising:

a first deflecting roller and a second deflecting roller coupled to one of said first or second elevator cars, each deflecting roller protruding laterally over a sidewall of said one of said first or second elevator cars and respectively deflecting one of said first or second rope-sections, wherein when said first limiting element is in the limiting position, said first limiting element overlaps a vertical projection of one of said first or second deflecting rollers, and wherein when said first limiting element is in the release position, said first limiting element does not overlap a vertical projection of said first or second deflecting rollers.

12. The elevator installation of claim 1, wherein when said first limiting element is in the limiting position, it engages behind one of said first or second rope-sections.

13. An elevator installation, comprising:

an elevator shaft;

a first elevator car disposed in, and moveable in an upward and downward vertical direction, within said shaft;

a second elevator car disposed in said shaft below said first elevator car, and moveable, separately from said first elevator car, in an upward and downward vertical direction within said shaft;

a first counterweight coupled to said first elevator car by a first rope arrangement connected there between;

a second counterweight coupled to said second elevator car by a second rope arrangement connected there between, at least one of said first or second rope arrangements comprising a first rope-section and a second rope-section that each extend along at least one side of said respective first or second elevator car to which said rope-sections are not coupled; and a limiting member having a first limiting element, said limiting member being fixed at a predetermined position in said shaft and assigned to said first rope-section, said limiting member being configured to limit oscillations of said first rope-section, wherein said first limiting element is configured to be selectively switched between a limiting position and a release position, based on a vertical position in said elevator shaft of said first or second elevator car that is coupled to its respective counterweight by said respective rope-section, wherein in the limiting position, said first limiting element is configured to contact a side of said first rope-section that faces said first or second elevator car that is coupled to its respective counterweight by said first rope-section, and wherein in the release position, said first limiting element releases said first rope-section.

14. The elevator installation of claim 13, further comprising:

a drive pulley disposed above both the first and second elevator cars, wherein said second rope arrangement comprises a second supporting rope having said first and second rope-sections configured as first and second supporting rope-sections that each extend laterally along said first elevator car, said second supporting rope being guided around and supported on said drive pulley and coupling said second elevator car to said second counterweight, and wherein each of said first and second supporting rope-section is assigned a limiting member.

15. The elevator installation of claim 14, wherein said limiting element of each limiting member is configured to be actuated to its limiting position when said second elevator car exceeds a predetermined minimum distance below said limiting member, and wherein said limiting element of each limiting member is configured to be actuated to its release position when said second elevator car is less than the predetermined minimum distance below said limiting member.

16. The elevator installation of claim 13, further comprising:

a rope deflecting device disposed in said elevator shaft below both of said first and second elevator cars, wherein said first rope arrangement comprises a first compensating rope having said first and second rope-sections configured as first and second compensating rope-sections that each extend laterally along said second elevator car, said first compensating rope being guided around said rope deflecting device and coupling said first elevator car to said first counterweight, and wherein each of said first and second compensating rope-section is assigned a limiting member.

17. The elevator installation of claim 16, wherein said limiting element of each limiting member is configured to be actuated to its limiting position when said first elevator car exceeds a predetermined minimum distance above said limiting member, and wherein said limiting element of each limiting member is configured to be actuated to its release position when said first elevator car is less than the predetermined minimum distance above said limiting member.

18. The elevator installation of claim 13, further comprising:

a first deflecting roller and a second deflecting roller coupled to one of said first or second elevator cars, each deflecting roller protruding laterally over a sidewall of said one of said first or second elevator cars and respectively deflecting one of said first or second rope-sections, wherein when said first limiting element is in the limiting position, said first limiting element overlaps a vertical projection of one of said first or second deflecting rollers, and wherein when said first limiting element is in the release position, said first limiting element does not overlap a vertical projection of said first or second deflecting rollers.

19. The elevator installation of claim 13, wherein when said first limiting element is in the limiting position, the first limiting element engages with one of said first or second rope-sections.

20. The elevator installation of claim 13, wherein said limiting member has a first limiting element and a second limiting element that are configured to clamp around one of said first or second rope sections when said first and second limiting elements are in the limiting position.

* * * * *